US005950697A

United States Patent [19]

Hobbs

[11] Patent Number: 5,950,697

[45] Date of Patent: Sep. 14, 1999

[54] FUNNEL WITH ON/OFF VALVE

[75] Inventor: Rick Anthony Hobbs, Sterling Heights, Mich.

[73] Assignee: Specialty Auto Parts U.S.A., Inc., Roseville, Mich.

[21] Appl. No.: 08/997,577

[22] Filed: Dec. 23, 1997

[51] Int. Cl.[6] ..... B67C 11/00

[52] U.S. Cl. ..... 141/344; 141/335

[58] Field of Search ..... 141/331–342, 141/344, 345

[56] References Cited

U.S. PATENT DOCUMENTS

| | | | |
|---|---|---|---|
| 285,168 | 9/1883 | Schussler et al. | 141/335 |
| 300,439 | 6/1884 | Bishop | 141/344 |
| 493,994 | 3/1893 | Gaudron . | |
| 647,111 | 4/1900 | Paradis . | |
| 690,576 | 1/1902 | Hesse . | |
| 886,237 | 4/1908 | Murtha | 141/335 |
| 897,782 | 9/1908 | Reilley | 141/345 |
| 967,356 | 8/1910 | Fajen et al. | 141/345 |
| 1,094,098 | 4/1914 | Rakottyay | 141/335 |
| 1,104,354 | 7/1914 | Gentle | 141/335 |
| 1,113,648 | 10/1914 | Karlson | 141/335 |
| 1,167,580 | 1/1916 | MacKenzie . | |
| 1,293,575 | 2/1919 | Tapman, Jr. . | |
| 1,425,100 | 8/1922 | Jones et al. . | |
| 1,631,194 | 6/1927 | Fahrney | 141/344 |
| 1,992,187 | 2/1935 | Carvalho . | |
| 2,130,876 | 9/1938 | Cordts . | |
| 2,193,508 | 3/1940 | Cordts . | |
| 2,715,488 | 8/1955 | Conlon . | |
| 3,123,106 | 3/1964 | Parhaniemi . | |
| 3,176,728 | 4/1965 | Baumann . | |
| 3,543,814 | 12/1970 | Aluotto | 141/335 |
| 3,630,083 | 12/1971 | Gorans . | |
| 3,763,903 | 10/1973 | Ouchterlony . | |
| 4,202,386 | 5/1980 | Orr . | |
| 4,598,743 | 7/1986 | Milling . | |
| 4,712,595 | 12/1987 | Wilson . | |
| 4,796,470 | 1/1989 | Lahde . | |
| 4,804,026 | 2/1989 | Bailey . | |
| 4,901,776 | 2/1990 | Attinello . | |
| 5,253,842 | 10/1993 | Huebscher et al. . | |
| 5,277,233 | 1/1994 | Fleming . | |
| 5,289,854 | 3/1994 | Baker et al. . | |
| 5,289,855 | 3/1994 | Baker et al. . | |
| 5,431,205 | 7/1995 | Gebhard . | |
| 5,458,168 | 10/1995 | Lindgren . | |
| 5,511,595 | 4/1996 | Stidham | 141/339 |
| 5,515,892 | 5/1996 | Najafi et al. . | |

FOREIGN PATENT DOCUMENTS

| | | | |
|---|---|---|---|
| 411333 | 6/1910 | France | 141/335 |
| 562510 | 11/1923 | France | 141/345 |
| 564.975 | of 1924 | France . | |
| 753048 | 10/1933 | France | 141/335 |
| 1076750 | 10/1954 | France | 141/335 |
| 226434 | 5/1943 | Switzerland | 141/335 |
| 267944 | 8/1927 | United Kingdom | 141/335 |

*Primary Examiner*—J. Casimer Jacyna
*Attorney, Agent, or Firm*—Harness, Dickey & Pierce, P.L.C.

[57] ABSTRACT

An on/off valve for a liquid-directing funnel having a tapered funnel outlet spout features a substantially spherical occluding element resident in the outlet spout. The diameter of the occluding element is such that the occluding element rests against the wall of the tapered spout close to a funnel outlet to prevent passage of liquid therethrough while minimizing discharge at the funnel outlet when the occluding element shuts off flow from the funnel. The occluding element's position in the outlet spout is determined by a wire-like element protruding from the occluding element out of the funnel outlet, the protruding element extending substantially parallel to the outlet spout axis and then bending to form a transverse arm which contacts a rim of a vessel being filled by the funnel whenever one wishes to start flow therefrom.

3 Claims, 1 Drawing Sheet

FUNNEL WITH ON/OFF VALVE

BACKGROUND OF THE INVENTION

The present invention relates to a funnel having an on/off valve or switch. The funnel is of the type having a large upper liquid holding reservoir portion at a funnel inlet and a tapered outlet or discharge tube extending from a base of the reservoir portion and tapering to a funnel outlet.

Many prior approaches to providing funnels with shut off elements have been proposed. However, all known prior approaches are somewhat complex and expensive to manufacture, given that they require the valve or occluding element to have substantial weight or spring pressure to assure a complete seal against a hard-to-manufacture distinct valve seat formed in the inner walls of the funnel device.

One such known funnel is disclosed in U.S. Pat. No. 1,094,098 and features a valve 22 which is raised by wires 23 and 26. A hook portion 28 of wire 26 is brought into engagement with the wall of a container opening to open the valve allowing fluid held in the funnel to pass through the outlet end of a funnel spout into the container. The valve or occluding element 22 of the '098 patent is mounted in the reservoir portion and its sloping sidewalls must match substantially exactly with the tapered walls of the funnel's reservoir in order to provide an adequate liquid-tight seal. A further disadvantage of approaches such as disclosed in the '098 patent is that the liquid in the entire outlet spout of the funnel will drain therefrom even after the occluding valve closes, thereby maximizing spillage of excess fluid when one desires to cease the exit of fluid from the funnel outlet.

Therefore, there is seen to be a need for a simplified occluding element which does not require a separately constructed valve seat to preclude outflow of fluid from the funnel's outlet end while minimizing escape of excess fluid from the funnel spout once the valve or occluding element has been positioned to halt liquid flow from the funnel.

SUMMARY OF THE INVENTION

To meet the above described need, a funnel having a tapered discharge tube of substantially circular cross-section tapering from a tube inlet to a funnel outlet includes a substantially spherical occluding element for placement in the discharge tube, the occluding element having a diameter greater than a diameter of the funnel outlet and less than a diameter of the discharge tube inlet.

In another aspect of the invention, a funnel having a tapered discharge tube of substantially circular cross-section tapers from a tube inlet to a funnel outlet and is equipped with an on/off valve comprising a substantially spherical occluding element for placement in the discharge tube and having a diameter greater than a diameter of the funnel outlet and less than a diameter of the discharge tube inlet. The on/off valve further comprises an occluding element actuator having a first member coupled to the occluding element and extending beyond the funnel outlet when the occluding element is seated in the discharge tube, and a second member coupled to an end of the first member remote from the occluding element and extending toward the discharge tube inlet exteriorly of the discharge tube, and a third member coupled to an end of the second member remote from the first member and extending transversely away from a longitudinal axis of the discharge tube.

BRIEF DESCRIPTION OF THE DRAWING

Objects and features of the invention will become apparent from a reading of a detailed description in conjunction with the drawing, in which.

DETAILED DESCRIPTION

Figure 1:
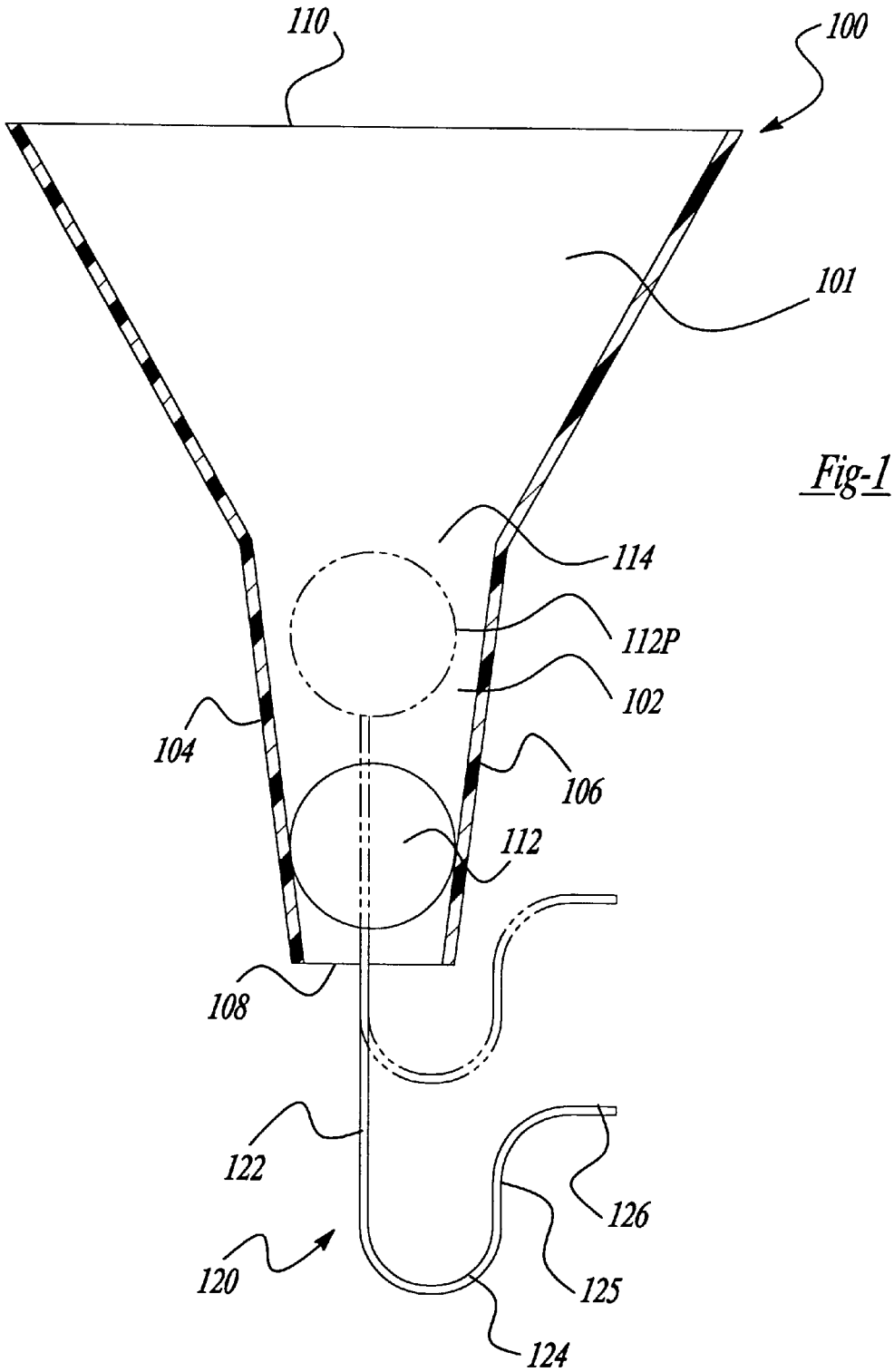
FIG. 1 is a cross-sectional view of a funnel equipped with an on/off switch or occluding element arranged in accordance with the principles of the invention.

With reference to FIG. 1, funnel 100 has, opening at its inlet end 110, a reservoir portion 101 which, in the usual case, tapers downwardly to an inlet end 114 of an outlet tube or spout 102 whose outer walls 104, 106 taper toward funnel outlet 108. Outlet spout walls 104 and 106 are therefore seen to approach each other as one proceeds axially along the funnel's outlet spout 102.

Resident within the funnel outlet spout (at least in the off or closed position thereof) is an occluding element 112 which comprises a substantially spherical ball having a diameter slightly greater than the diameter of the cross-section of the outlet tube or spout 102 at the outlet end 108, but smaller than the diameter of the cross-section of the spout 102 at the spout inlet 114. The diameter of the occluding ball 112 is chosen depending upon where in the outlet spout 102 one wishes the occluding ball 112 to rest when no further liquid is to be discharged from the funnel outlet 108. Naturally, the closer to outlet end 108 the ball rests in the occluding position, the lower the amount of excess fluid in the outlet spout 102 which will escape from the funnel 100 once the decision has been made to close the funnel outlet.

It should be noted that occluding element 112 need not necessarily comprise a complete spherical ball, but may be truncated, or otherwise be non-spherically shaped at its top or bottom with respect to funnel outlet spout 102. What is required is that the occluding element have at least a substantially lateral surface for contact with the converging wall of spout 102.

FIG. 1 shows the occluding element 112 in its closed position in solid lines while an open position of element 112P is shown in phantom dashed lines.

To manually achieve the on or off position of the occluding element 112, an actuator 120 is coupled to the occluding element 112. A first portion or member 122 of actuator 120 extends outwardly from the funnel outlet 108 in a direction substantially parallel to a longitudinal axis of the outlet spout 102 to a bend 124 wherein the element 120 then has a second member 125 extending in a reverse direction and terminating in a transversely extending arm or third member 126. When the user of funnel 100 desires flow from the funnel outlet 108 to commence, arm 126 is raised toward the funnel outlet end 108 to, in turn, raise occluding element 112 thereby allowing flow of fluid around occluding element 112 and out of the funnel outlet 108. In the usual case, arm 126 would be forced against the rim of an opening into a container into which the fluid is to be transferred. When a user desires flow of fluid out of outlet 108 to cease, then pressure in an upward direction on arm 126 or bend 124 is released and the occluding ball 112 will, under the force of gravity, fall to the lower position shown in FIG. 1 to halt flow of fluid out of funnel 100.

The advantage of using a ball-shaped valve inside the angled or tapering funnel outlet spout as described above is that the exact position of the occluding ball is not important. The spherical shape of at least a lateral surface of element 112 offers advantages of:

1.) creating an effective seal by simply allowing the occluding element to fall to the lowest point possible in outlet spout 102 under the size constraints of the diameter of the lateral spherical surface;

2.) eliminating the need for a separately machined or molded valve seat; and

3.) eliminating the requirement of parallelism between member 122 of actuator 120 and a longitudinal axis of outlet spout 102.

Further adding to the simplicity of the invention is the fact that the element 120, which actuates up and down motion of the occluding ball 112, need not be perfectly aligned with respect to any valve seating location, since rotation of a ball-shaped occluding valve will not affect the performance of the liquid-tight seal desired.

Actuator 120 can be fabricated from a variety of materials, such as metallic wire or plastic. If the occluding element 112 and actuator 120 are fabricated to form a single unitary construction, then the material used preferably has high flexibility for ease of placement of the occluding element and actuator into the funnel outlet. For example, the element 120 could comprise a linear element bent to the final shape shown in FIG. 1 after the occluding ball 112 and attached (or integral) member 120 have been positioned with respect to funnel 100 with element 112 in outlet spout 102 and member 120 extending from element 112 substantially linearly out of funnel outlet 108.

The invention has been described with reference to an exemplary embodiment and is to be limited only by the scope and spirit of the appended claims.

I claim:

1. In a funnel having a reservoir portion integrally formed with a tapered discharge tube of substantially circular cross-section, the discharge tube forming a smooth unobstructed fluid flow path tapering from a tube inlet formed by an opening having a diameter, coupling the reservoir portion to the discharge tube, to a tube outlet formed by an opening having a diameter which is less than the inlet opening diameter and having a longitudinal axis, an on/off valve comprising:

a substantially spherical occluding element for placement in the discharge tube and having a diameter greater than a diameter of the tube outlet and less than a diameter of the tube inlet, the occluding element having an outer surface formed to establish a liquid tight seal with an inner wall of the discharge tube between the tube inlet and the tube outlet as a result of gravity acting upon the occluding element; and an occluding element actuator comprising:

a single elongated member coupled to the occluding element extending in a first direction through the discharge tube and outwardly of the tube outlet, thence in a second direction back toward the funnel exteriorly of a single side of the discharge tube and thence outwardly in a single third direction transversely away from the longitudinal axis of the discharge tube.

2. The valve of claim 1, wherein the occluding element and the occluding element actuator are formed in a single piece.

3. The valve of claim 1, wherein the diameter of the occluding element is closer in length to the diameter of the funnel outlet than to the diameter of the tube inlet.

* * * * *